US005346101A

United States Patent [19]

Hargis et al.

[11] Patent Number: 5,346,101

[45] Date of Patent: Sep. 13, 1994

[54] SPARGER CONTAINER FOR SHIPMENT OF DRY MATERIALS

[75] Inventors: Gary W. Hargis, Gordon; David Francis, Milledgeville; Clifton A. Brooks, Gordon, all of Ga.

[73] Assignee: Hargis Container Corporation, Gordon, Ga.

[21] Appl. No.: 47,410

[22] Filed: Apr. 19, 1993

[51] Int. Cl.[5] ..... B67D 5/06

[52] U.S. Cl. ..... 222/195; 406/38; 406/146; 134/166 R

[58] Field of Search ..... 222/195; 406/38, 39, 406/41, 136, 137, 146; 134/166 R, 169 R

[56] References Cited

U.S. PATENT DOCUMENTS

| | | | |
|---|---|---|---|
| 1,872,548 | 8/1932 | Löwen | 222/195 X |
| 2,580,215 | 12/1951 | Bozich | 405/137 X |
| 2,653,116 | 9/1953 | Whitcomb et al. | 134/10 |
| 2,732,944 | 1/1956 | Hays | 406/137 X |
| 3,182,669 | 5/1965 | Campbell et al. | 134/105 |
| 3,201,175 | 8/1965 | Keves et al. | 406/137 |
| 3,379,478 | 4/1968 | Aller et al. | 406/10 |
| 3,512,842 | 5/1970 | Milewski et al. | 406/136 X |
| 3,552,799 | 1/1971 | Koranda | 406/137 |
| 3,860,018 | 1/1975 | Reiter | 134/166 R |
| 4,189,263 | 2/1986 | Krug, Jr. et al. | 406/137 |
| 4,363,574 | 12/1982 | Bjurling | 406/137 |
| 4,708,488 | 11/1987 | Ericsson | 366/2 |
| 4,785,966 | 11/1988 | Waltke | 220/345 |
| 4,830,546 | 5/1989 | Withiam et al. | 406/41 |
| 5,110,366 | 5/1992 | McGregor | 406/137 X |
| 5,199,826 | 4/1993 | Lawrence | 406/137 X |

FOREIGN PATENT DOCUMENTS

| | | | |
|---|---|---|---|
| 645399 | 9/1962 | Italy | 222/195 |

*Primary Examiner*—Andres Kashnikow
*Assistant Examiner*—Kenneth Bomberg
*Attorney, Agent, or Firm*—Mason, Fenwick & Lawrence

[57] ABSTRACT

A sparger container comprises a pair of opposed end walls, a pair of opposed side walls, and a closed floor. The closed floor has an open-topped, longitudinally-extending channel and two generally planar sides slanting upwardly from the top edges of the channel to the side walls. A sparger system is provided immediately above the floor and includes a generally rectangular network of pipes disposed along the inner perimeter of the side and end walls, and at least one inlet providing fluid communication between a source of pressurized fluid and the pipes. The sparger system can also include a pipe positioned above the channel. Each of the pipes is provided with a plurality of holes therethrough, which are evenly-spaced circumferentially and are positioned at spaced intervals along the lengths of the pipes. An outlet for the container is positioned at one end of the channel and extends through one of the end walls. Alternatively, the channel can be omitted, and the floor includes only two generally planar sides slanting upwardly from the longitudinal center line of the floor to the side walls.

10 Claims, 3 Drawing Sheets

SPARGER CONTAINER FOR SHIPMENT OF DRY MATERIALS

BACKGROUND OF THE INVENTION

1. Field of the Invention

The present invention relates to sparger containers for the shipment of dry materials. More specifically, the invention relates to sparger containers into which pressurized air and/or water can be introduced following transport to slurry the dry materials for handling.

2. Related Art

A number of containers are known for carrying dry powdered materials and for mixing the materials with a liquid or gas for handling.

U.S. Pat. No. 4,830,546 to Withiam et al. discloses a hopper car with means for admitting a liquid, such as water, to form a slurry with the material being shipped. There are a series of cables affixed to the car so that passages are formed within the body of powder so that the water spreads around faster and more evenly.

U.S. Pat. No. 4,785,966 to Waltke discloses a shipping container of undisclosed size, in which the bottom of the container is slanted as in a hopper. A powder valve is provided at the bottom of the container.

U.S. Pat. No. 4,708,488 to Ericsson discloses a container in the form of a double bottomed load body for a change-load vehicle. Below the load supporting bottom are passages through which liquid is forced into the body of the load. The liquid is mixed with the load by cycling from pressure to suction. Means are also provided for using the mixing machinery to off-load the slurry.

U.S. Pat. No. 4,363,574 to Bjurling discloses a cylindrical powder container carried in a rectangular frame. The container is filled and emptied by air entraining the powdered cargo. The container is rotated to provide the desired surface to the air stream for best loading and unloading.

U.S. Pat. No. 3,379,478 to Aller et al. discloses a rail car for shipping powdered material such as cement. There are means for passing air into and out of the car to fluid entrain the powder, and to aid in unloading the car. The car is configured to include two cylindrical end sections which are inclined upwardly from the center, so that draft forces are carried through the interior to aerate and fluidize the powder.

U.S. Pat. No. 3,201,175 to Keves et al. discloses a distributor pipe or sparger arranged along the perimeter of the bottom of a shipping hopper. The distributor pipe passes liquid into the body of material being shipped to fluidize the material and entrain it for movement across the surface of the bottom towards a drain trough.

None of these containers is particularly well-adapted for use as a free-standing shipping container of the type used on ships or trailer frames. Such shipping containers must meet ISO and Department of Transportation (DOT) requirements.

SUMMARY OF THE INVENTION

Accordingly, it is a primary object of the invention to provide a sparger container which is free-standing for use on ships, trailer frames, and the like, and which meets ISO and DOT requirements.

It is another object of the present invention to provide a sparger container for the shipment of powdered materials in a dry condition, which enables the powdered materials to be slurried for handling upon reaching their destination.

These and other objects of the invention are achieved by the provision of a sparger container comprising a pair of opposed end walls, a pair of opposed side walls, and a closed floor. The closed floor has an open-topped, longitudinally-extending channel and two generally planar sides slanting upwardly from the top edges of the channel to the side walls. A sparger system is provided immediately above the floor and includes a generally rectangular network of pipes disposed along the inner perimeter of the side and end walls, and at least one inlet providing fluid communication between a source of pressurized fluid and the pipes. The sparger system can also include a pipe positioned above the channel. Each of the pipes is provided with a plurality of holes therethrough. An outlet for the container is positioned in the channel.

In one aspect of the invention, the outlet is positioned at one end of the channel and extends through one of the end walls.

In another aspect of the invention, the holes through the pipes are evenly-spaced circumferentially and are positioned at spaced intervals along the lengths of the pipes.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which.

DETAILED DESCRIPTION OF THE PREFERRED

Figure 1:
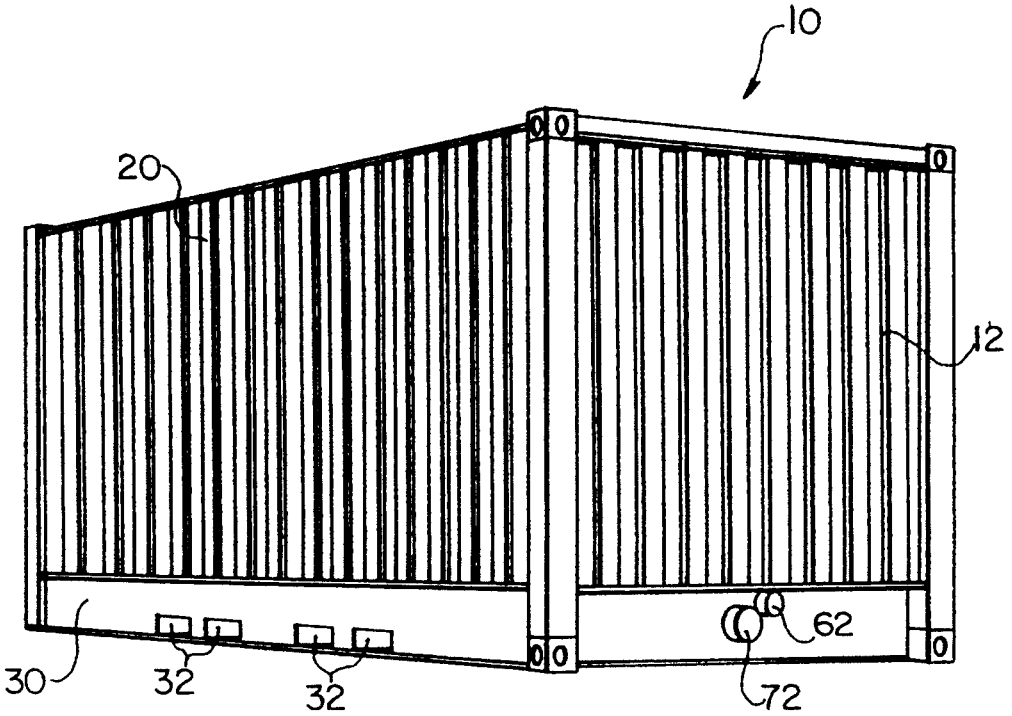
FIG. 1 is a perspective view of a first embodiment of a sparger container in accordance with the present invention.

In describing preferred embodiments of the present invention illustrated in the drawings, specific terminology is employed for the sake of clarity. However, the invention is not intended to be limited to the specific terminology so selected, and it is to be understood that each specific element includes all technical equivalents which operate in a similar manner to accomplish a similar purpose. Referring now to FIGS. 1–5, there is shown a first embodiment of a sparger container 10 in accordance with the present invention. Container 10 has a generally rectangular cross-section and includes a first and second opposed end walls 12 and 14, first and second opposed side walls 20 and 22, a closed top 24, and a closed floor 26. End walls 12 and 14 and side walls 20 and 22 are corrugated in conventional manner, except for a generally planar plinth 30 extending around the perimeter of container 10. Fork pockets 32 can be formed in side walls 20 and 22 at the bottom of plinth 30, to enable container 10 to be transported by a forklift.

Figure 2:
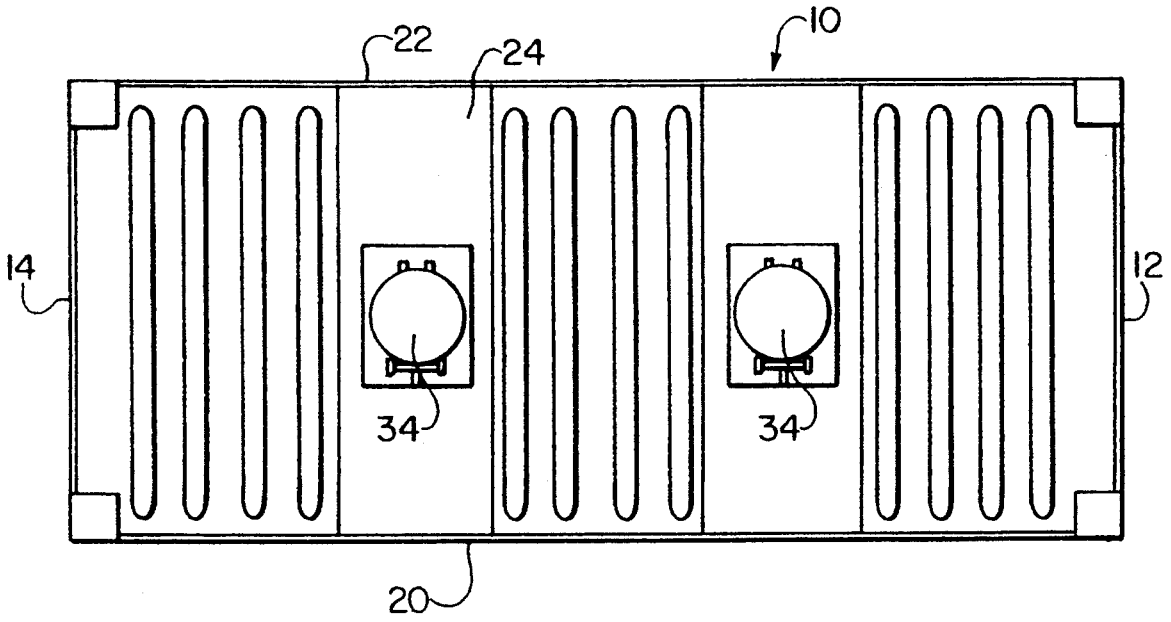
FIG. 2 is a top plan view of the container of FIG. 1.

Top 24 is provided with a pair of conventional spaced manways 34, illustrated in FIG. 2.

Figure 4:
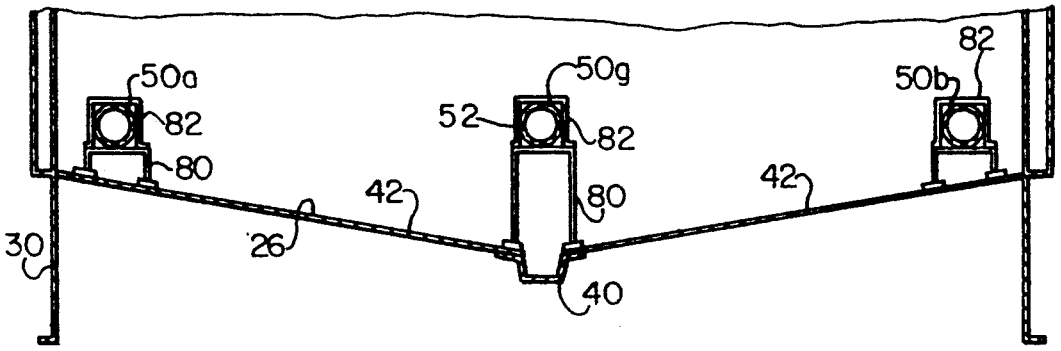
FIG. 4 is a cross-sectional view, taken along line 4—4 of FIG. 3.
Figure 5:
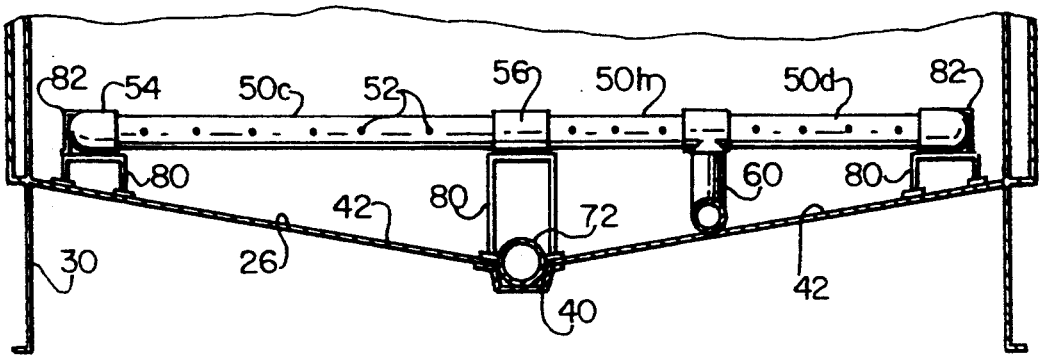
FIG. 5 is a cross-sectional view, taken along line 5—5 of FIG. 3.

As shown in FIGS. 4 and 5, floor 26 is formed in three parts, an open-topped, longitudinally-extending channel 40, and two planar sides 42 which slant upwardly from the top edges of channel 40 to side walls 20 and 22. In order to prevent damage during transport by forklift, the bottom surface of channel 40 is positioned above the upper surfaces of fork pockets 32. Seals (not shown) can be placed along the edges of the joints between the edges of channel 40 and the edges of sides 42, in order to ensure that the joints are leak-free.

A sparger system is disposed immediately above floor 26. The sparger system comprises a network of pipes 50 disposed along the inner perimeter of walls 12, 14, 20, and 22 and above channel 40. All of pipes 50 are provided with a plurality of holes 52 evenly-spaced circumferentially and at spaced intervals along their lengths. Pipes 50 preferably are made of polyvinyl chloride (PVC), for example, schedule 400 PVC, stainless steel, steel, or any other material suitable for carrying a liquid such as water and/or a gas such as air. The size of the pipes and holes, and the spacing of the holes will depend upon the application, in a manner which is well known to those of skill in the art.

Side pipes 50*a* and 50*b* disposed inwardly of side walls 20 and 22 are joined to end pipes 50*c*, 50*d*, 50*e*, and 50*f* disposed inwardly of end walls 12 and 14 in conventional manner using elbow joints 54. Center pipe 50*g* is joined to end pipes 50*c* and 50*h* at one end and end pipes 50*f* and 50*i* at the other end in conventional manner using T-joints 56.

Fluid communication between a pressurized source of gas (e.g., air) and/or liquid (e.g., water) and pipes 50 is provided by a pair of right angle inlet pipes 60 positioned at either end of the sparger system and extending out through end walls 12 and 14. Inlet pipes 60 are fluid connected to end pipes 50*d* and 50*h* at one end and end pipes 50*e* and 50*i* at the other end. Inlet pipes 60 are provided with threaded nipples 62 or other conventional couplings at their free ends for connection to hoses in a conventional manner. As can best be seen in FIG. 5, the L shape of inlet pipes 60 causes nipples 62 to be extend outwardly through end walls 12 and 14 below the level of pipes 50.

An outlet pipe 70 is provided at one end of channel 40 for draining the slurried material out of container 10. Outlet pipe 70 extends out through end wall 12, and is provided with a threaded nipple 72 or other conventional coupling for connection to a hose in a conventional manner.

Figure 3:
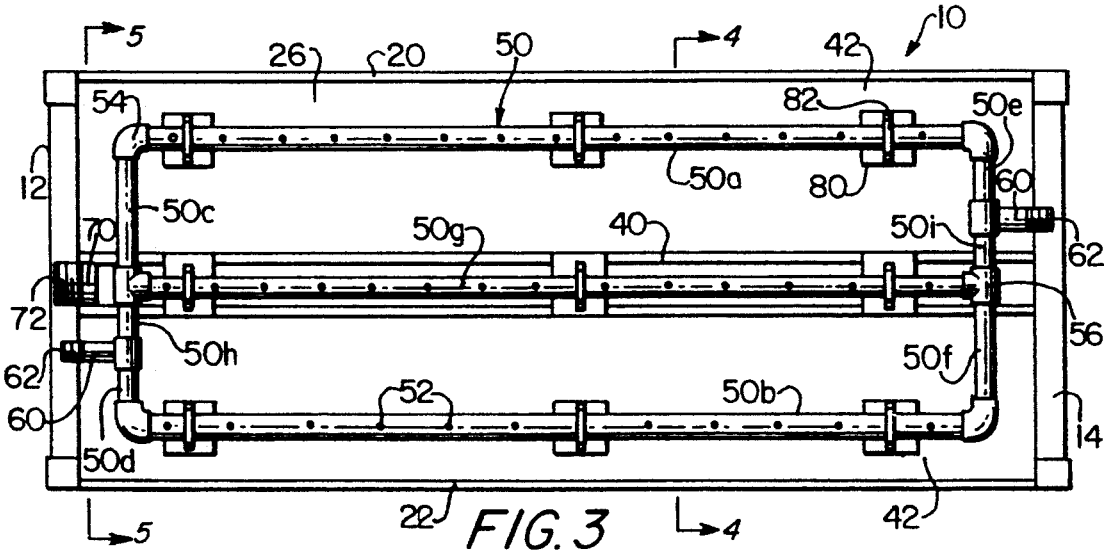
FIG. 3 is a top plan view of the container of FIG. 1, with the top removed.

Pipes 50 are maintained in position in container 10 by a plurality of brackets 80 and associated saddles or straps As shown in FIGS. 3–5, side pipes 50*a* and 50*b* and center pipe 50*g* each rest on three spaced apart brackets 80 which are welded to floor 26. One bracket 80 is placed approximately at the center of pipes 50*a*, 50*b*, and 50*g*, while another bracket 80 is spaced inwardly from each end of pipes 50*a*, 50*b*, and 50*g*. A saddle 82 is placed over pipes 50*a*, 50*b*, and 50*g* at each of brackets 80, and its free ends are fastened to its corresponding bracket 80 using bolts or other conventional means.

In use, container 10 is filled with a powdered dry material through manways 34, and then transported via ship or truck to its destination. Once arrived at its destination, nipples 62 are connected to a source of pressurized gas and/or liquid. The gas and/or liquid spraying out of holes 52 in pipes 50 wets and agitates the powdered material to form a slurry. When the flow of gas and/or liquid is discontinued, agitation will cease, and the slurry will flow down sides 42 of floor 26 and into channel 40. Nipple 72 can be connected to a hose, and the slurry drained from channel 40 through nipple 72.

Figure 6:
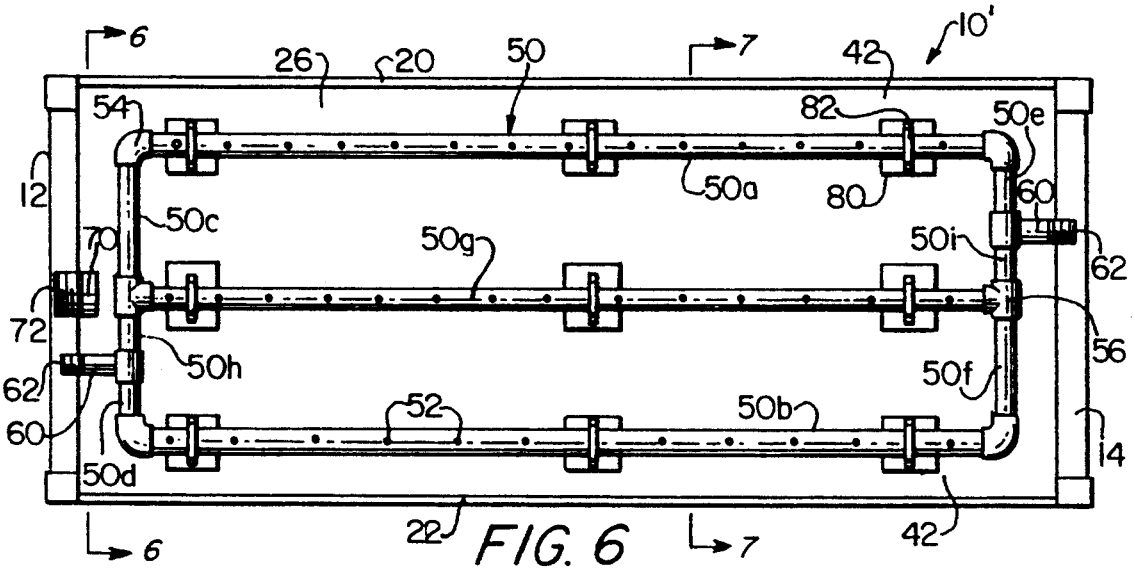
FIG. 6 is a top plan view of a second embodiment of a sparger container in accordance with the present invention, with the top removed.
Figure 7:
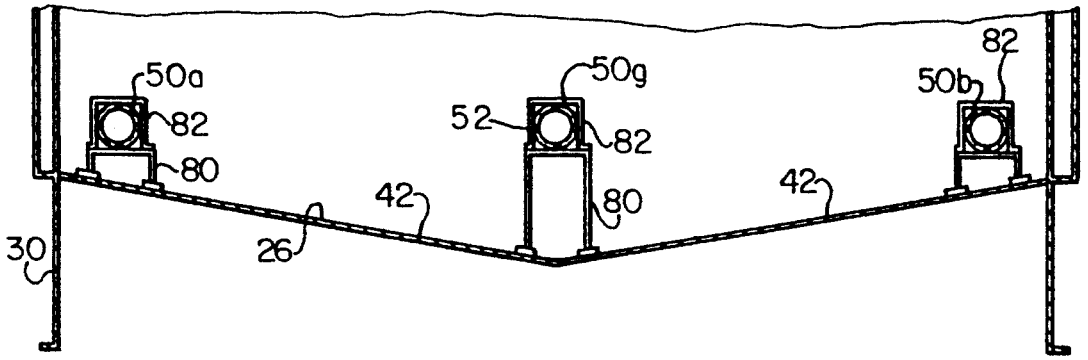
FIG. 7 is a cross-sectional view, taken along line 7—7 of FIG. 6.
Figure 8:
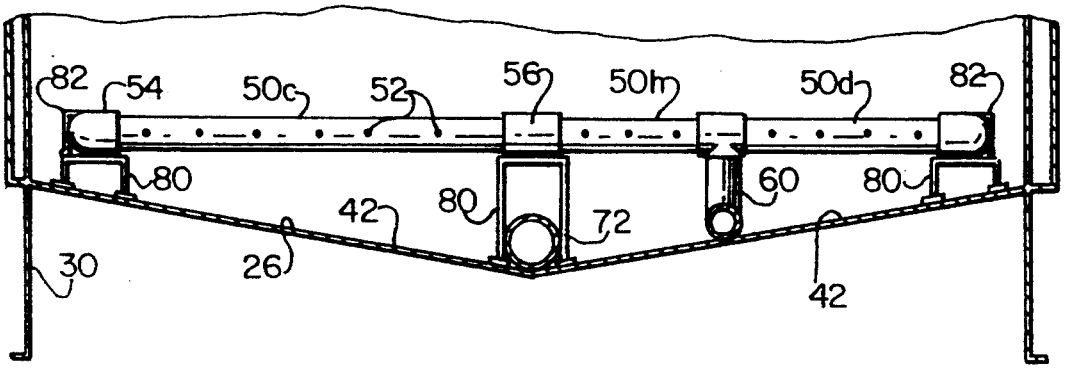
FIG. 8 is a cross-sectional view, taken along line 8—8 of FIG. 6.

Referring now to FIGS. 6–8, there is shown a second embodiment of a sparger container 10! in accordance with the present invention. Container 10' is identical to container 10, except that floor 26 does not include a channel; instead, its two planar sides 42 slant upwardly from the longitudinal center line of floor 26 to side walls 20 and 22; and outlet pipe 70 is provided at one end of floor 26 at its nadir. Container 10' is used in the same way as container 10.

Modifications and variations of the above-described embodiments of the present invention are possible, as appreciated by those skilled in the art in light of the above teachings. It is therefore to be understood that, within the scope of the appended claims and their equivalents, the invention may be practiced otherwise than as specifically described.

What is claimed is:

1. A sparger container comprising:

a pair of opposed end walls;

a pair of opposed side walls;

a closed floor including an open-topped, longitudinally-extending channel having top edges, and two generally planar sides slanting upwardly from said top edges of said channel to said side walls;

a sparger system including a generally rectangular network of pipes disposed along the inner perimeter of said side and end walls, and at least one inlet providing fluid communication between a source of pressurized fluid and said pipes, said pipes being provided with a plurality of holes therethrough; and an outlet positioned in said channel.

2. The sparger container of claim 1, wherein said sparger system further includes a pipe positioned above said channel.

3. The sparger container of claim 1, wherein said outlet is positioned at one end of said channel and extends through one of said end walls.

4. The sparger container of claim 1, wherein said holes through said pipes are evenly-spaced circumferentially and are positioned at spaced intervals along the lengths of said pipes.

5. The sparger container of claim 1, wherein said pipes are positioned immediately above said floor.

6. A sparger container comprising:

a pair of opposed end walls;

a pair of opposed side walls;

a closed floor having a longitudinal center line and including two generally planar sides slanting upwardly from said longitudinal center line to said side walls to define a nadir;

a sparger system including a generally rectangular network of pipes disposed along the inner perimeter of said side and end walls, and at least one inlet providing fluid communication between a source of pressurized fluid and said pipes, said pipes being provided with a plurality of holes therethrough; and an outlet positioned at said nadir of said floor.

7. The sparger container of claim 6, wherein said sparger system further includes a pipe positioned above said longitudinal center line.

8. The sparger container of claim 6, wherein said outlet is positioned at one end of said floor and extends through one of said end walls.

9. The sparger container of claim 6, wherein said holes through said pipes are evenly-spaced circumferentially and are positioned at spaced intervals along the lengths of said pipes.

10. The sparger container of claim 6, wherein said pipes are positioned immediately above said floor.

* * * * *